United States Patent [19]

McIntyre

[11] Patent Number: 5,004,195

[45] Date of Patent: Apr. 2, 1991

[54] RACK FOR FLEXIBLE COLLECTION BAGS

[75] Inventor: Jonothon M. W. McIntyre, North Hollywood, Calif.

[73] Assignee: Lomac Corporation, Encino, Calif.

[21] Appl. No.: 498,264

[22] Filed: Mar. 21, 1990

Related U.S. Application Data

[63] Continuation-in-part of Ser. No. 379,287, Jul. 13, 1989.

[51] Int. Cl.[5] ..... B65B 67/04

[52] U.S. Cl. ..... 248/99; 15/257.9; 294/1.1

[58] Field of Search ..... 248/95, 99, 100, 101, 248/97; 15/257.1, 257.6, 257.9; 294/1.1

[56] References Cited

U.S. PATENT DOCUMENTS

| | | | |
|---|---|---|---|
| 972,870 | 10/1910 | Kandlbinder | 248/99 |
| 996,421 | 6/1911 | McCausland | 248/99 |
| 1,353,330 | 9/1920 | Erickson | 248/101 |
| 1,928,844 | 10/1933 | Seibert | 248/99 |
| 2,213,929 | 9/1940 | Hoffman | 248/99 |
| 3,747,653 | 7/1973 | Ringer | 248/99 X |
| 3,838,839 | 10/1974 | Spencer | 248/99 |
| 4,319,726 | 3/1982 | Andersson | 248/99 X |
| 4,856,740 | 8/1989 | MacLeod et al. . | |

OTHER PUBLICATIONS

Photocopy of packaging for a product Called the Super Sweep, Manufacturer/Distributor: Idea Development, Inc., P.O. Box 89524, Sioux Fall, S.D. 57105; 124 Main St., Box 248, Worthing, S.D. 57077.

*Primary Examiner*—Gary L. Smith
*Assistant Examiner*—Michael J. Milano
*Attorney, Agent, or Firm*—Kelly, Bauersfeld & Lowry

[57] ABSTRACT

A rack for supporting a flexible collection bag in an open configuration includes a channel-like stake having a lower spiked end, a receiving slot adjacent to an upper end, and a bag support ring positioned within the receiving slot and supported by the stake. The bag support ring comprises a generally triangular, closed segment of bent wire having an integral U-shaped support anchor which is offset from the primary plane of the support ring. This U-shaped support anchor is positioned within the channel of the stake and engages an inner surface to fix the bag support ring at an angle of approximately 60 degrees relative to the longitudinal axis of the stake. A cap is slidably positioned over the upper end of the stake, and a lid is clipped to a portion of the bag support ring. The lid is pivotable with respect to the bag support ring and includes a basket for holding a deodorant cake. When an open end of a flexible collection bag is draped over the bag support ring, the lid is utilized to enclose the open end and thus enclose its contents.

21 Claims, 2 Drawing Sheets

2
10
22
3
24
50
3
7
7
62
18
12
16
2
20

50
28
10
54
40
46
44
42
56
38
58
14
36
24
34
12
32
30

56
42
60
58

42
22
14
16

48
10
14
16
26
12

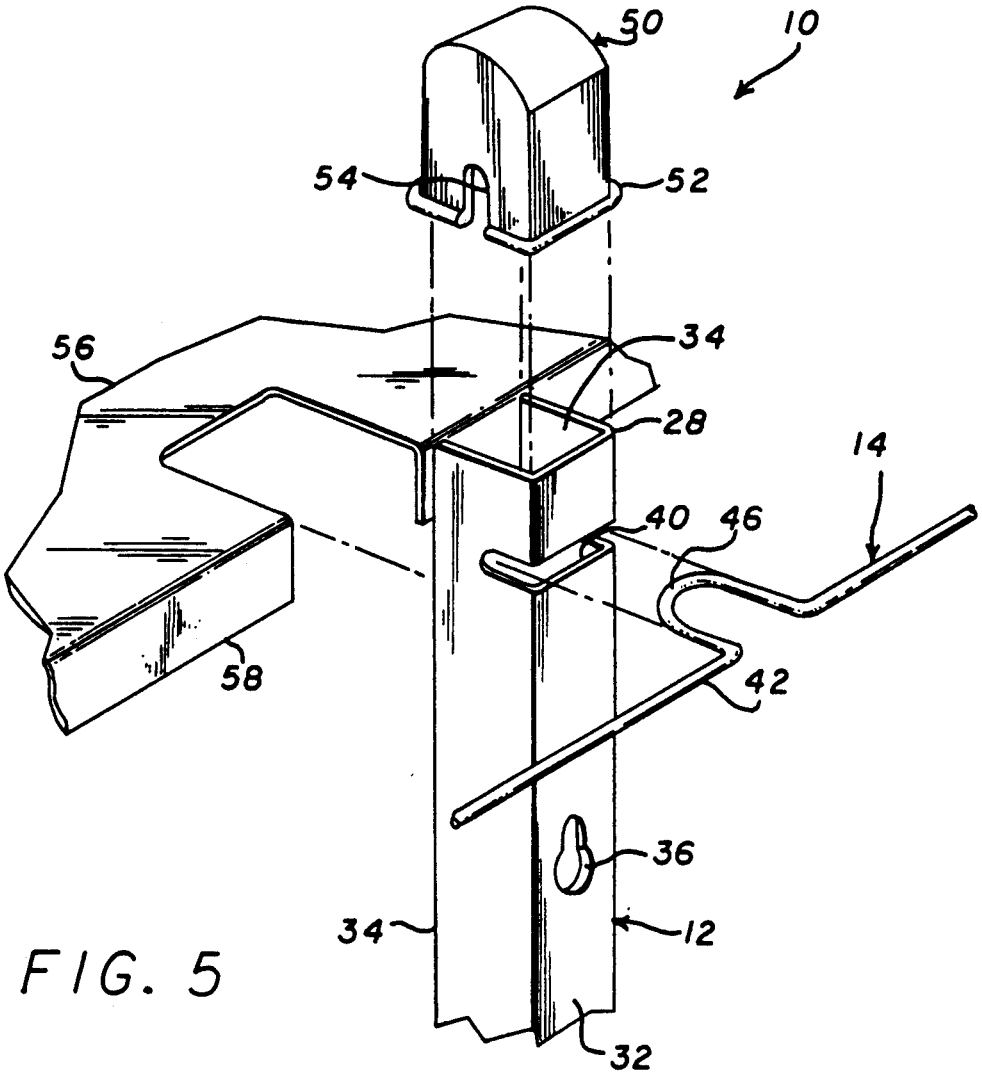
FIG. 5
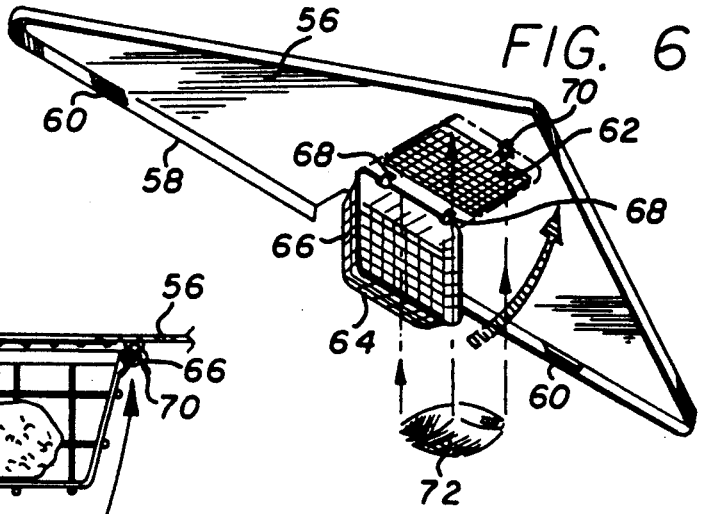
FIG. 6
FIG. 7
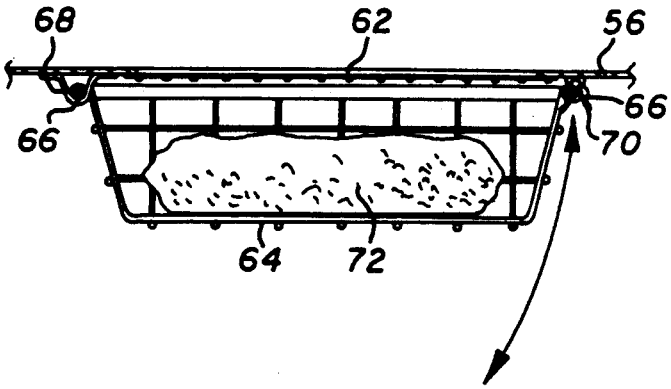

RACK FOR FLEXIBLE COLLECTION BAGS

RELATED APPLICATION

This is a continuation-in-part application of U.S. patent application Ser. No. 07/379,287, filed July 13, 1989 and entitled RACK OR HOLDER FOR FLEXIBLE GARBAGE BAGS.

BACKGROUND OF THE INVENTION

This invention relates generally to portable receptacles for collecting articles. More specifically, the present invention relates to a rack for supporting a flexible collection bag in an open configuration.

The development of high-strength flexible collection bags has led to increasing use of such bags by consumers for a number of purposes, including the collection of trash, the collection and storage of recyclable aluminum cans, for the storage of other household items, the lining of various containers, etc. Using the well-known plastic garbage bag as an example, most flexible collection bags have a generally unitary, enclosing side wall, a permanently closed lower end and an openable upper end.

Many specialty devices have been developed in order to support lawn bags, garbage bags and similar types of collection bags, in a generally vertical open configuration to facilitate loading thereof. One exemplary refuse bag support is shown in U.S. Pat. No. 4,856,740, the contents of which are incorporated herein. There, an articulated bag support frame is shown which can be adjusted to accommodate bags of different sizes, and to support such bags over varying terrain and in different vertical and horizontal orientations. As discussed in U.S. Pat. No. 4,856,740, there have been a number of such support frame devices developed, all having as a basic purpose that of holding the openable upper end of the flexible bag in an open configuration and supporting the bag in a desired orientation.

A disadvantage of many of the prior devices is that they are either too costly or they are lacking in durability and strength, because of their basic design. Some prior devices have so many different parts that they must be assembled at a factory, thereby driving up the final cost to the consumer, or they are manufactured in such a way that they are too heavy to be easily carried by the consumer from one location to another. Other devices are restrictive in the manner in which they may be used, thus decreasing the overall utility of the article.

Accordingly, there has been a need for a novel rack for supporting a flexible collection bag in an open configuration which is durable, lightweight and economical to manufacture. Such a novel rack should be easily assembled and disassembled by a consumer, and capable of being stored in a flat configuration for shipping and handling. Additionally, a rack for supporting a flexible collection bag in an open configuration is needed which may be used in a number of different ways. Preferably, such a rack should be capable of use on a horizontal surface in order to permit leaves or other refuse to be swept and/or raked into the bag. Additionally, such a rack should be self-supporting and, in the alternative, capable of being hung or supported upon a vertical wall if desired. Moreover, a novel collection bag supporting rack is needed which provides means for deodorizing the contents of the bag. The present invention fulfills these needs and provides other related advantages.

SUMMARY OF THE INVENTION

The present invention resides in an improved rack for supporting a flexible collection bag in an open configuration, which is of simplified construction, lightweight and economical. The supporting rack comprises, generally, a stake having a lower end and a receiving slot adjacent to an upper end thereof, and means insertable through the receiving slot for supporting the periphery of the flexible bag in an open configuration. A cap is slidably positioned over the upper end of the stake to substantially enclose the stake receiving slot and prevent unintended disassociation of the bag supporting means from the stake, and means are provided for covering an upper end of the flexible bag when supported by the rack.

In a preferred form of the invention, the stake includes a base wall extending the length of the stake, and a pair of facing side walls joined to opposite longitudinal edges of the base wall. The lower end of the stake is spiked in order to facilitate driving the stake into the ground, and overall the stake has a channel-like configuration. The receiving slot extends across the entire width of the base wall and approximately one half the width of the side walls perpendicularly of the longitudinal axis of the stake. Keyway means are provided in the base wall for hanging the stake on a nail or the like.

The bag supporting means includes means insertable through the receiving slot for engaging the stake and thereby fixing the bag supporting means relative to the stake. More particularly, the bag support means comprises a bag supporting ring formed of a closed segment of wire which is bent into a generally triangular configuration. This triangular bag support ring includes a rear support member and two front support members which all lie in a primary support ring plane. The rear support member includes an integral U-shaped support anchor which is offset from the primary plane. The support anchor is inserted through the stake receiving slot and engages an inner surface of the base wall. The U-shaped support anchor extends away from the primary plane of the bag support ring and is configured such that when the bag support ring is assembled to the stake, the U-shaped support anchor positions the two front support members at an angle of approximately 60 degrees relative to the longitudinal axis of the stake.

The cap which is slidably positioned over the upper end of the stake includes two opposite slots extending upwardly from a lower end thereof. These slots accommodate sliding the cap over portions of the rear support member adjacent to the U-shaped support anchor.

A flexible bag having a generally unitary, enclosing side wall, a permanently closed lower end and an openable upper end, is supported by the rack. The periphery of the openable upper end of the flexible bag is held in an open configuration by draping it over the bag support ring. Means pivotable with respect to the bag support ring are provided for covering the openable upper end of the flexible bag and selectively enclosing, in connection with the bag, articles placed within the bag.

The means for covering the open end of the flexible collection bag comprises a lid having at least one clip-like hinge for removably attaching the lid to the rear support member. The lid is configured to substantially overlie and rest upon the bag support ring in a closed configuration. The hinge, which may be clipped over a portion of the bag as it is draped over the bag support ring, pivots away from the front support members to an open configuration providing access to the bag or its contents.

Means are provided for deodorizing the flexible collection bag and its contents. The deodorizing means includes a basket hinged to the undersurface of the lid for holding a deodorant cake. The deodorant cake is held within the basket so as to be exposed to the collection bag and its contents. The basket is hinged to the underside of the lid to facilitate replacement of the deodorant cake, and a screen is provided in the lid immediately over the basket. This permits the deodorant cake to be easily inspected when the lid is closed.

The rack for supporting a flexible collection bag in an open configuration may be easily assembled and disassembled, and in the assembled state may be used in a number of ways. First, the keyway means permits the stake to be hung adjacent to a wall on a nail or the like. The spiked lower end of the stake permits the rack to be driven into the ground and become self-supporting. The angular relationship between the bag support ring and the stake further permits the rack to be laid on a horizontal surface and still maintain the bag in its open configuration, for raking leaves or other refuse into the bag.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 5 is an enlarged exploded rear perspective view of the upper end of the stake, illustrating the manner in which the bag support ring, a cap and the lid are assembled to the stake to form the rack of the present invention;

FIG. 6 is a perspective view of the underside of the lid, illustrating a basket which is hinged to the lid for holding a deodorant cake; and FIG. 7 is an enlarged, fragmented and partially sectional view taken generally along the line 7—7 of FIG. 1, illustrating the manner in which the basket holds the deodorant cake immediately adjacent to the underside of the lid.

DETAILED DESCRIPTION OF THE PREFERRED EMBODIMENT

Figure 1:
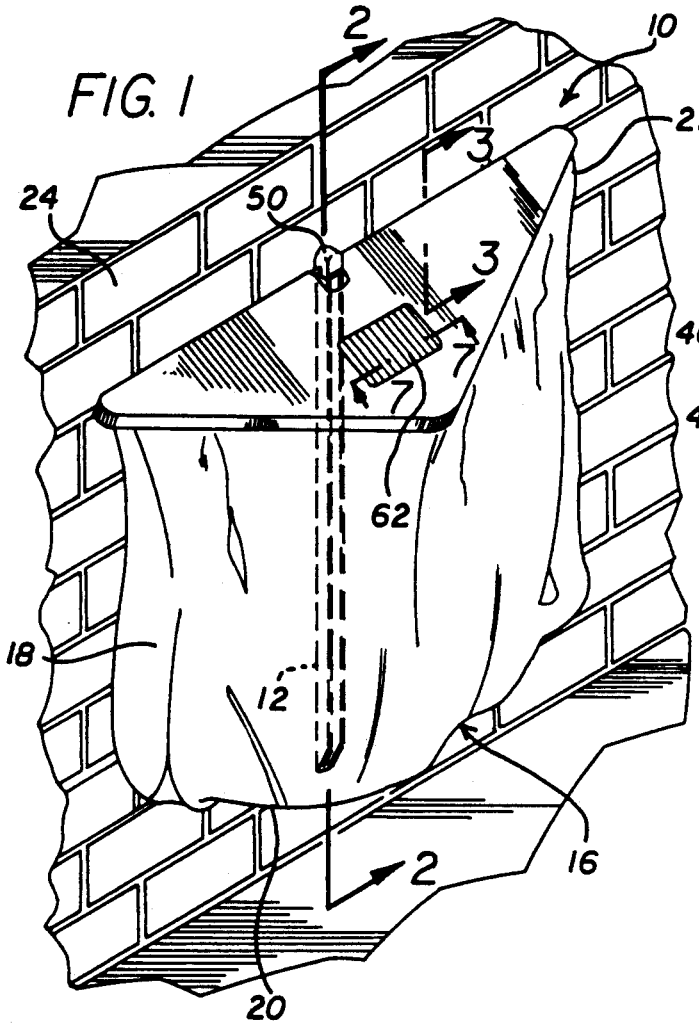
FIG. 1 is a front perspective environmental view of a rack for supporting a flexible collection bag embodying the invention, illustrating the rack hanging upon a generally vertical wall, and showing the manner in which a flexible collection bag is supported by the rack.
Figure 2:
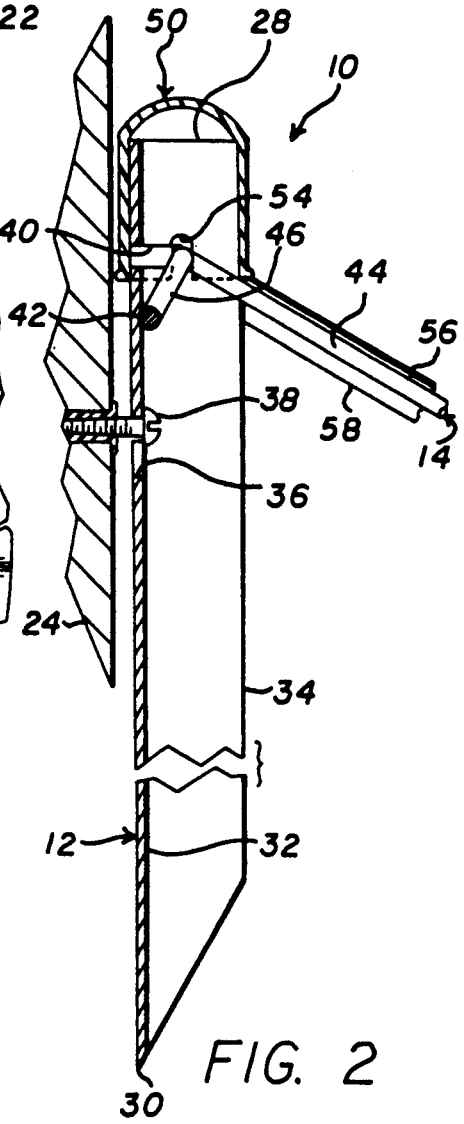
FIG. 2 is an enlarged sectional and partially fragmented view taken generally along the line 2—2 of FIG. 1, illustrating the manner in which a stake is held adjacent to the wall by a screw, and further illustrating the manner in which a bag support ring is assembled to the stake.
Figure 3:
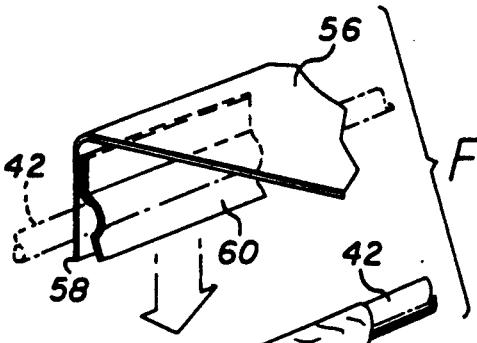
FIG. 3 is a fragmented, exploded perspective view taken of area designated by the line 3—3 of FIG. 1, showing the manner in which a lid is attached to a rear support member of the bag support ring.

As shown in the drawings for purposes of illustration, the present invention is concerned with an improved rack for supporting a flexible collection bag in an open configuration, wherein the rack is generally designated in the accompanying drawings by the reference number 10. As illustrated in FIGS. 1, and 2, the rack 10 comprises, generally, a stake 12 and a bag support ring 14 which is assembled to the stake 12. A flexible collection bag 16 is supported by the ring 14, and includes a generally unitary, enclosing side wall 18, a permanently closed lower end 20, and an openable upper end 22. The periphery of the upper end 22 is held in an open configuration by the bag support ring 14.

Figure 4:
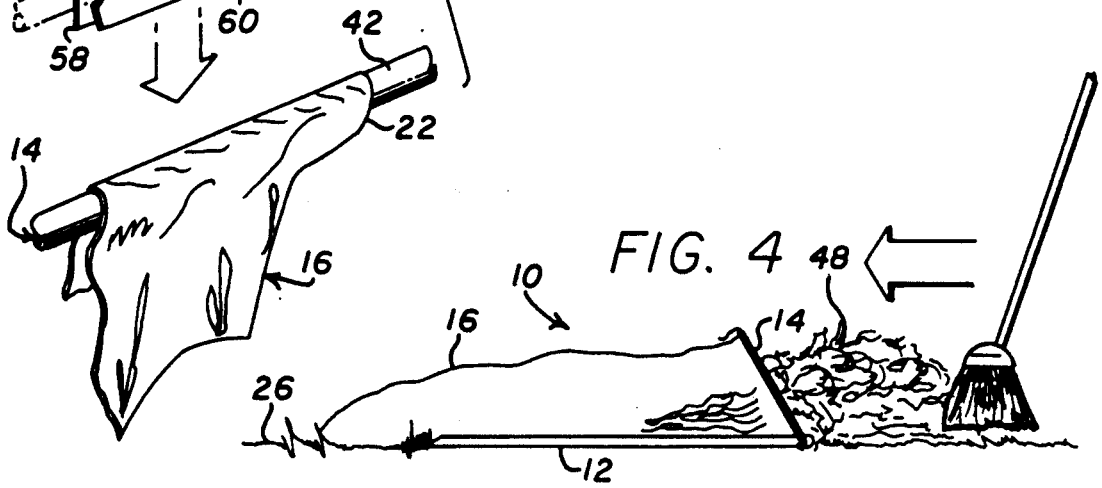
FIG. 4 is an elevational view of the rack illustrated in FIG. 1 with the lid removed, showing the manner in which the rack can be conveniently placed upon a ground surface for purposes of sweeping or raking refuse into the attached collection bag.

As shown in FIG. 1, the stake 12 may be hung adjacent to a wall 24, or, as shown in FIG. 4, the rack 10 may be laid upon the ground 26 for sweeping leaves or other refuse into the bag 16. In both instances, the bag support ring 14 maintains the bag upper end 22 in an open configuration. Additionally, the lower end of the stake 12 can be driven into the ground 26 so that, if desired, the rack 10 can be self-supporting.

In accordance with the present invention, and as illustrated with respect to a preferred embodiment in FIGS. 1 through 5, the stake 12 has a channel-like configuration extending from an upper end 28 to a spiked lower end 30. The stake 12 includes a rearward base wall 32 which extends the length of the stake, and a pair of facing side walls 34 which are joined to opposite longitudinal edges of the base wall 32. A keyway 36 is formed in the base wall 32 near the upper end 28 of the stake 12, in order to permit the stake to be hung on a screw 38 or the like, anchored within the wall 24.

A receiving slot 40 is provided in the stake 12 adjacent to its upper end 28. The thickness of the receiving slot 40 corresponds substantially to the thickness of the bag support ring 14. This slot 40 extends across the entire width of the base wall 32 and approximately one half the width of the side walls 34 perpendicularly of the longitudinal axis of the stake 12.

The bag support ring 14 comprises a closed segment of wire which is bent into a generally triangular configuration. The bag support ring 14 includes a rear support member 42 and two front support members 44, which collectively form the three sides of the triangle and which all lie in a primary plane. The rear support member 42 includes an integral, centrally situated, U-shaped support anchor 46 which is offset from the primary plane. The support anchor 46 is inserted through the stake receiving slot 40 and engages an inner surface of the base wall 32 to fix the position of the bag support ring 14 relative to the stake 12.

More particularly, the U-shaped support anchor 46 is configured for insertion through the receiving slot 40, to be housed within the channel of the stake 12 between the side walls 34. The support anchor 46 extends away from the primary plane of the back support ring 14 at an approximate 90 degree angle. The support anchor 46 has a length such that when the rear support member 42 is fully inserted into the receiving slot 40, and when the U-shaped support anchor 46 rests against the base wall 32, the front support members 44 will be fixed at an angle within the range of 50 degrees to 85 degrees relative to the longitudinal axis of the stake 12. Preferably this angle is approximately 60 degrees.

The non-perpendicular angular relationship between the stake 12 and the primary plane of the bag support ring 14 has been found to be a desirable characteristic of the rack 10 in order to expand the utility of the rack 10. When hung adjacent to a wall 24 (FIGS. 1 and 2), the downward angle of the bag support ring 14 provides a desirable top access angle to the upper end 22 of the bag 16. When the rack 10 is placed on a horizontal surface such as the ground 26, the non-perpendicular angular relationship between the bag support ring 14 and the stake 12 tends to maintain the bag upper end 22 in a desirable position which facilitates the raking or sweeping of leaves 48 or other refuse into the bag 16. Additionally, when placed on soft ground 26, horizontal movement of the rack 20 tends to be limited by the stake 12, and more particularly by the action of the spiked lower end 30 of the stake as it digs into the ground 26 when the leaves 48 or the like are raked into the bag 16.

A cap 50 is slidably positioned over the upper end 28 of the stake 12 to substantially enclose the stake receiving slot 40 and prevent unintended disassociation of the bag support ring 14 from the stake. The cap 50 includes a lower flange 52 which assists a user in sliding the cap over the upper end 28 of the stake, and two opposite slots 54 which extend upwardly from a lower end of the cap. These slots 54 accommodate sliding the cap 50 over portions of the rear support member 42 adjacent to the U-shaped support anchor 46.

As illustrated best in FIGS. 1, 3, 6 and 7, a lid 56 is provided for covering the upper end 22 of the bag 16 and selectively enclosing, in connection with the bag, articles placed therein. The lid 56 has an overall configuration generally matching that of the back support ring 14, and includes a lip 58 surrounding its periphery, which is designed to also surround the bag support ring 14 when the lid 56 is closed over the top of the bag 16. The lid 56 further includes two clip-like hinges 60. These hinges 60 are fixed to the inner surface of the rearward lip 58, and are configured to snap-fit over portions of the rear support member 42. As shown best in FIG. 3, the hinges 60 may be snap-fit over the rear support member 42 after the upper end 22 of the bag 16 is draped over the bag support ring 14. The illustrated construction of the hinges 60 permits the lid 56 to be removed from the bag support ring 14 when desired. In a closed configuration, the lid 56 lies substantially flat against the bag support ring 14 to enclose, in connection with the bag 16, the contents thereof. When pivoted away from the front support members 44 to an open configuration, access is provided to the bag's contents.

With particular reference to FIGS. 6 and 7, centrally located on the lid 56 is a screen 62. This screen is positioned directly above a basket 64 having an upper rim 66. A pair of basket hinges 68 fixed to an undersurface of the lid, engage the rim 66 and permit the basket 64 to be pivoted relative to the lid 56. A basket clip 70 is also fixed to the undersurface of the lid 56 to detachably engage a portion of the basket rim 66 and hold it securely adjacent to the undersurface of the lid 56 in connection with the basket hinges 68.

Disposed within the basket 64 is a deodorant cake 72. The screen 62 facilitates inspection of the deodorant cake 72 when the lid 56 is closed. If the cake 72 must be replaced, the basket 64 can be readily detached from the clip 70 and pivoted downwardly upon the hinges 68.

The construction of the rack 10 permits the various components thereof to be packaged, shipped and sold in a relatively flat configuration. This minimizes shipping costs and reduces the volume required to display the goods at a point of sale. Since there are only four separable components, assembly of the rack 10 is quite simple. After identifying the stake 12, the bag support ring 14, the cap 50 and the lid 56, a consumer would be instructed to simply insert the U-shaped support anchor 46 into the receiving slot 40 as shown in FIG. 5. The front support members 44 would then be rotated about the rear support member 42 in the receiving slot 40, upwardly over the upper end 28 of the stake 12 until the support anchor 46 engages the inner surface of the base wall 32 as illustrated in FIG. 2. In this configuration, the front support members 44 have their predetermined downward angle relative to the longitudinal axis of the stake 12. The cap 50 is then simply placed over the upper end 28 of the stake to substantially cover the receiving slot 40. This has the effect of locking the bag support ring 14 in position. The upper end 22 of the bag 16 can then be draped over the bag support ring 14, and the lid 56 can be clipped, via the hinges 60, directly onto the rear support member 42. Assembly of the rack 10, together with the flexible collection bag 16, is then complete.

Following assembly of the bag 16 to the rack 10, the rack can be used in a number of different ways. As shown in FIGS. 1 and 2, the keyway 36 provides convenient means for hanging the rack 10 adjacent to a generally vertical wall 24. A user may prefer such an arrangement in the home, garage or some other structure. The rack 10 can be easily removed from the wall 24 and used in the yard or garden as a refuse collection device, as shown in FIG. 4. When the rack 10 is placed on a horizontal surface such as the ground 26, as leaves 48 are raked into the bag 16, the spiked end 30 of the stake 12 tends to dig into the ground and thus prevent unwanted movement of the rack 10. Moreover, the angular relationship between the bag support ring 14 and the stake 12 maintains the upper end 22 of the bag in its desired opened configuration. Additionally, the rack 10 can be driven into the ground 26 to provide a free-standing support for the collection bag 16.

Although a particular embodiment of the invention has been described in detail for purposes of illustration, various modifications may be made without departing from the spirit and scope of the invention. Accordingly, the invention is not to be limited, except as by the appended claims.

I claim:

1. A rack for supporting a flexible collection bag in an open configuration, the rack comprising:

a stake including a lower end, a receiving slot adjacent to an upper end thereof, and an inner surface;

a bag support ring having a primary plane and including a rear support member and at least one front support member which lie in the primary plane, wherein the rear support member includes an integral U-shaped support anchor offset from the primary plane, the support anchor being inserted through the stake receiving slot and engaging the stake inner surface to fix the bag support ring relative to the stake; and a cap slidably positioned over the upper end of the stake to substantially enclose the stake receiving slot and prevent unintended disassociation of the bag support ring from the stake.

2. A rack as set forth in claim 1, including means pivotable with respect to the bag support ring for substantially covering an open end of the flexible collection bag when supported by the rack.

3. A rack as set forth in claim 2, wherein the means for substantially covering the open end of the flexible collection bag includes a lid having at least one clip-like hinge along an edge thereof, for removably attaching the lid to the rear support member, wherein the lid is configured to substantially overlie and rest upon the bag support ring in a closed configuration, and pivot away from the at least one front support member in an open configuration.

4. A rack as set forth in claim 3, wherein the lid includes means for deodorizing the flexible collection bag and its contents.

5. A rack as set forth in claim 4, wherein the deodorizing means includes a basket hinged to the lid, for holding a deodorant cake in a manner wherein the deodorant cake is exposed to the flexible collection bag and its contents.

6. A rack as set forth in claim 5, wherein the basket is hinged to an underside of the lid, and wherein the lid includes a screen positioned over the basket.

7. A rack as set forth in claim 1, wherein the stake includes a rearward base wall extending the length of the stake, which provides the inner surface, a pair of facing side walls joined to opposite longitudinal edges of the base wall and configured to create a spike at the lower end, and keyway means provided in the base wall for hanging the stake on a nail or the like.

8. A rack as set forth in claim 7, wherein the base and side walls form a channel extending substantially the length of the stake, and wherein the receiving slot comprises a slot having a thickness corresponding substantially to the thickness of the rear support member, wherein the slot extends across the entire width of the base wall and approximately one half the width of the side walls perpendicularly of the longitudinal axis of the stake.

9. A rack as set forth in claim 8, wherein the U-shaped support anchor of the rear support member is configured for insertion through the receiving slot to be housed within the channel, the U-shaped support anchor extending away from the primary plane of the bag support ring and being configured such that the bag support ring is fixed at an angle within the range of 50 degrees to 85 degrees relative to the longitudinal axis of the stake.

10. A rack as set forth in claim 9, wherein the bag support ring comprises a closed segment of bent wire.

11. A rack as set forth in claim 9, wherein the bag support ring has a generally triangular configuration, such that the rear support member forms one side of the triangle and is centrally supported by the stake, and two front support members integrally formed with the rear support member, which form the remaining sides of the triangle.

12. A rack as set forth in claim 9, wherein the cap includes two opposite slots extending upwardly from a lower end thereof, to accommodate sliding the cap over portions of the rear support member adjacent to the U-shaped support anchor.

13. A portable receptacle for collecting articles, the receptacle comprising:

a channel-like stake having an upper end and a spiked lower end, the stake including a rearward base wall extending the length of the stake, a pair of facing sidewalls joined to opposite longitudinal edges of the base wall, and a receiving slot extending through said base wall adjacent to the upper end;

means for supporting the periphery of a flexible bag in an open configuration, the bag supporting means including means insertable through the receiving slot for engaging the stake and thereby fixing the bag supporting means relative to the stake;

a flexible bag having a generally unitary, enclosing side wall, a permanently closed lower end and an openable upper end, the periphery of the openable upper end being held in an open configuration by the bag supporting means; and means pivotable with respect to the bag supporting means, for covering the openable upper end and selectively enclosing, in connection with the bag, articles placed within the bag.

14. A receptacle as set forth in claim 13, wherein the receiving slot comprises a slot having a thickness corresponding substantially to the thickness of the bag supporting means, wherein the slot extends across the entire width of the base wall and approximately one half the width of the side walls perpendicularly of the longitudinal axis of the stake.

15. A receptacle as set forth in claim 14, wherein the bag supporting means comprises a bag support ring having a primary plane and including a rear support member and at least one front support member which lie in the primary plane, wherein the rear support member includes an integral U-shaped support anchor offset from the primary plane, the support anchor being inserted through the stake receiving slot and engaging an inner surface of the base wall to fix the bag support ring relative to the stake.

16. A receptacle as set forth in claim 15, wherein the U-shaped support anchor of the rear support member is configured for insertion through the receiving slot to be housed within the channel-like stake, the U-shaped support anchor extending away from the primary plane of the bag support ring and being configured such that the bag support ring is fixed at an angle of approximately 60 degrees relative to the longitudinal axis of the stake.

17. A receptacle as set forth in claim 16, wherein the bag support ring comprises a closed segment of bent wire having a generally triangular configuration, such that the rear support member forms one side of the triangle and is centrally supported by the stake, and two front support members, integrally formed with the rear support member, form the remaining sides of the triangle.

18. A receptacle as set forth in claim 15, including a cap positioned over the upper end of the stake to substantially enclose the stake receiving slot and prevent disassociation of the bag support ring from the stake, the cap including two opposite slots extending upwardly from a lower end thereof, to accommodate sliding the cap over portions of the rear support member.

19. A receptacle as set forth in claim 13, wherein the means for covering the openable upper end of the bag includes a lid having at least one clip-like hinge along an edge thereof, for removably attaching the lid to the bag supporting means, wherein the lid is configured to substantially overlie and rest upon the bag supporting means in a closed configuration, and pivot away from the bag supporting means in an open configuration.

20. A receptacle as set forth in claim 19, wherein the lid includes means for deodorizing the flexible bag and its contents, wherein the deodorizing means includes a basket hinged to the lid for holding a deodorant cake.

21. A rack for supporting a flexible collection bag in an open configuration, the rack comprising:

a channel-like stake having an upper end and a spiked lower end, the stake including a rearward base wall extending the length of the stake, a pair of facing side walls joined to opposite longitudinal edges of the base wall, and a receiving slot adjacent to the upper end, wherein the receiving slot extends across the entire width of the base wall and approximately one half the width of the side walls perpendicularly of the longitudinal axis of the stake, and keyway means provided in the base wall below the receiving slot, for hanging the stake on a nail or the like;

means for supporting the periphery of a flexible bag in an open configuration, the bag supporting means including means insertable through the receiving slot for engaging the stake and thereby fixing the bag supporting means relative to the stake, the bag supporting means comprising a bag support ring having a primary plane and including a rear support member and a pair of integrally formed front support members which, collectively, have a triangular configuration and lie in the primary plane, wherein the rear support member includes an integral U-shaped support anchor offset from the primary plane, the support anchor being inserted through the stake receiving slot and engaging an inner surface of the base wall to fix the bag support ring relative to the stake at an angle of approximately 60 degrees relative to the longitudinal axis of the stake, wherein the bag support ring comprises a closed segment of bent wire;

a cap slidably positioned over the upper end of the stake to substantially enclose the stake receiving slot and prevent unintended disassociation of the bag support ring from the stake, the cap including two opposite slots extending upwardly from a lower end thereof, to accommodate sliding the cap over portions of the rear support member;

means pivotable with respect to the bag supporting means, for covering the bag supporting means and a bag supported thereon, the covering means including a lid having at least one clip-like hinge along an edge thereof, for removably attaching the lid to the rear support member, wherein the lid is configured to substantially overlie and rest upon the bag support ring in a closed configuration, and pivot away from the front support members in an open configuration; and means for deodorizing a flexible collection bag supported by the rack, the deodorizing means including a basket hinged to an underside of the lid, for holding a deodorant cake.

* * * * *